US006419047B1

(12) United States Patent
Adshead

(10) Patent No.: US 6,419,047 B1
(45) Date of Patent: Jul. 16, 2002

(54) PORTABLE LADDER HAVING RESISTANCE TO SLIPPAGE

(76) Inventor: Harold Frederick Adshead, 31 Brattswood Drive, Church Lawton, Stoke on Trent ST7 3EJ (GB)

( * ) Notice: Subject to any disclaimer, the term of this patent is extended or adjusted under 35 U.S.C. 154(b) by 0 days.

(21) Appl. No.: 09/629,471

(22) Filed: Jul. 31, 2000

(30) Foreign Application Priority Data

Aug. 11, 1999 (GB) ..... 9918813
Apr. 4, 2000 (GB) ..... 0008068

(51) Int. Cl.[7] ..... E06C 1/00; E04G 5/02
(52) U.S. Cl. ..... 182/180.2; 182/107; 248/238
(58) Field of Search ..... 182/214, 107, 182/121, 180.2, 180.3, 205, 171, 172; 248/238

(56) References Cited

U.S. PATENT DOCUMENTS

| | | | | | |
|---|---|---|---|---|---|
| 840,365 | A | * | 1/1907 | Pease | 182/107 |
| 1,116,098 | A | * | 11/1914 | Morrison | 182/180.2 |
| 1,381,397 | A | * | 6/1921 | Briles | 182/180.3 |
| 1,385,319 | A | * | 7/1921 | Enke | 182/172 |
| 2,485,685 | A | * | 10/1949 | Armstrong | 182/107 |
| 2,605,950 | A | * | 8/1952 | Colvin | 182/214 |
| 3,508,628 | A | * | 4/1970 | Conrad | 182/172 |
| 3,882,966 | A | | 5/1975 | Fasano | |
| 4,147,231 | A | * | 4/1979 | Chantler et al. | 182/107 X |
| 4,519,477 | A | * | 5/1985 | Ralston | 182/107 |
| 4,632,220 | A | * | 12/1986 | Murrell | 182/111 |
| 4,694,932 | A | | 9/1987 | Schmitt | |
| 5,086,876 | A | | 2/1992 | Severson | |
| 5,361,868 | A | | 11/1994 | Bartos | |
| 5,370,204 | A | * | 12/1994 | Fox | 182/180 X |
| 6,045,102 | A | * | 4/2000 | Terenzoni | 182/107 X |
| 6,053,284 | A | * | 4/2000 | Fountain | 182/180.2 |
| 6,253,876 | B1 | * | 7/2001 | Cosgrave et al. | 182/180.2 |

FOREIGN PATENT DOCUMENTS

| | | |
|---|---|---|
| DE | 19836977 | 3/1999 |
| FR | 2738280 | 3/1997 |
| GB | 144042 | 6/1920 |
| GB | 260403 | 11/1926 |
| GB | 1150117 | 4/1969 |
| GB | 2142076 A | 1/1985 |
| GB | 2275722 A | 9/1994 |
| GB | 2306548 A | 5/1997 |

* cited by examiner

*Primary Examiner*—Daniel P. Stodola
*Assistant Examiner*—Hugh B. Thompson
(74) *Attorney, Agent, or Firm*—Martin A. Hay

(57) ABSTRACT

A ladder is provided which has considerably reduced tendency to slip. Typically, the ladder 1 has rungs 5 and side members 2 with end caps 3 resting on the ground 4. Securing member 6, made typically from aluminium alloy, has friction member 7 provided with spikes 16. Pivot member 8 on the securing member 6 is fixed at one end on the securing member to opposite sides of the securing member, and at the other end is mounted through bolt 9 to the side member of the ladder. Flat spring 17 is fitted around the bolts 9, the spring being biassed to bring the securing member 6 against the side member 2. The pivot member is arcuate in shape to allow the securing member, when not in use to be positioned essentially flat against the ladder and not proud of the lower end of the side member. In use, the ladder is placed on the ground and against a wall. The securing member is pivoted against the bias of spring 17 so as to place it on the ground. To provide necessary latching, stay 10, freely swingable about bolt 13, is located in an appropriate notch 18 in the securing member. After use, the ladder is moved away from the wall, the securing means moved a little distance against the spring bias to release the stays from the notch, the securing means is allowed to move back to the ladder using the bias of the spring 17, at the same time trapping the stays against the side members.

17 Claims, 3 Drawing Sheets

PORTABLE LADDER HAVING RESISTANCE TO SLIPPAGE

Figure 1:
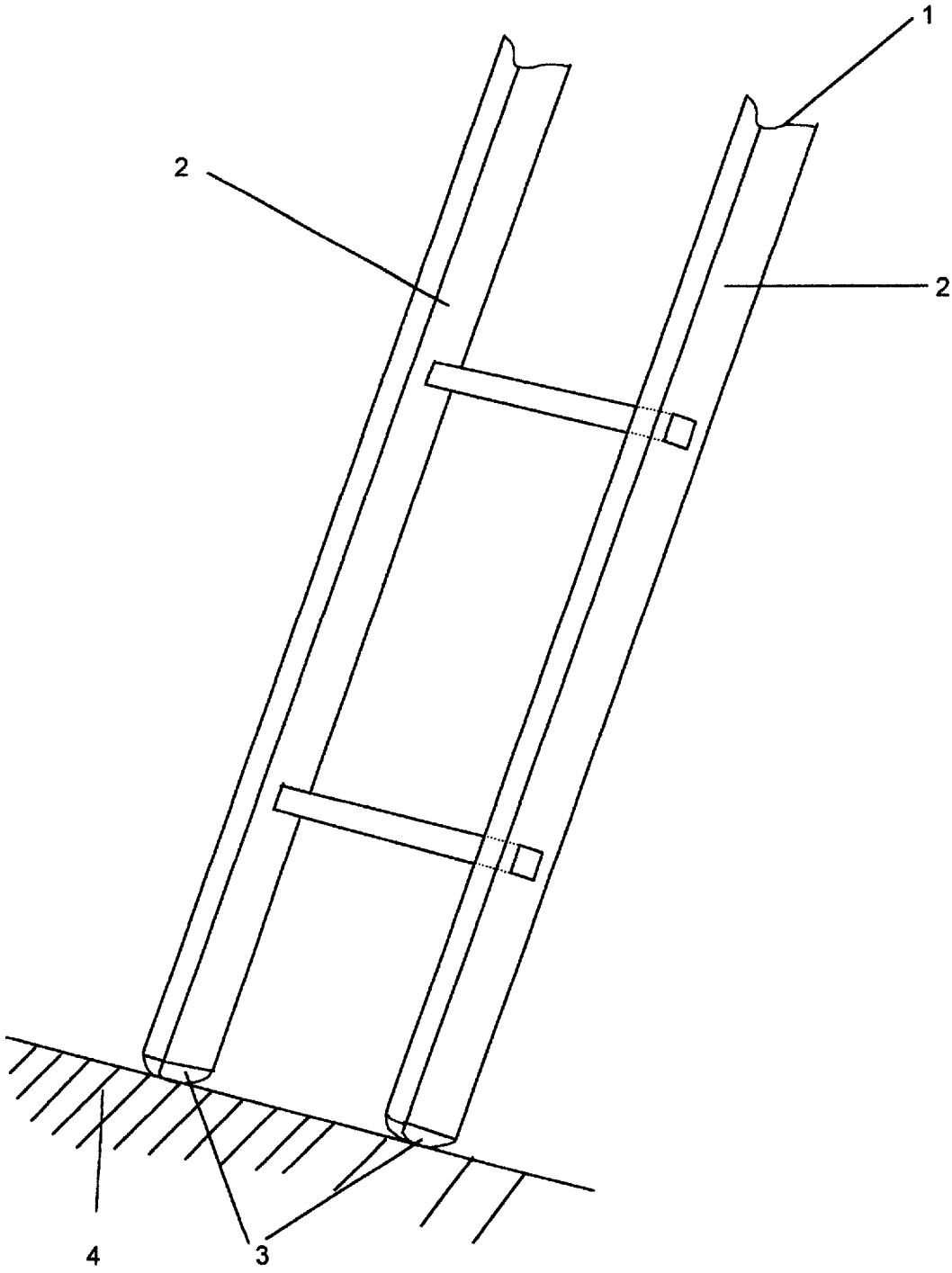
FIGURE 1 Prior Art

This invention relates to ladders and in particular to portable ladders.

Portable ladders usually comprise two side members, and interposed between the side members are located a plurality of conveniently spaced rungs. The number of rungs depends upon the length of the side members. Extending ladders comprise a number, generally two or three, of smaller ladders slidably disposed within the main ladder and capable of being secured to an upper rung of the main ladder. All these ladders are intended to rest at their lower end on the ground and at their upper end against a hard object, such as brickwork, scaffolding, tree, and the like. In this specification, the term "ground" includes any solid surface on which ladder is generally used, such as, for example, compacted soil, lawn, concrete, paving, wood. The object of a ladder is to enable a workman to attain a greater working height. Such use is conventional and extends to the professional workman and the amateur user around the house.

Many accidents are unfortunately associated with the use of ladders. Such accidents are not only those of missing rungs whilst climbing or coming down a ladder, but also those caused by the bottom of a ladder slipping on the ground. In such an event, the top of the ladder will move down the object against which it is resting, so causing the ladder to become unsteady and the user to fall. This can occur even though the ladder is initially being used within the recommended angle range of between 25° and 75° to the horizontal.

In order to assist in overcoming the problem of ladder slippage on the ground, caps are usually placed on both the upper and lower ends of the side members. Where the side members are tubular, caps are place on each of the four ends of the side members. Such caps have a smooth external surface and fit snugly over each end; the caps are generally made from hard rubber or plastic material by moulding. Where the side members have a rectangular or T- or I-cross section, the caps are similar but may have external ribs, having orientation at right angles to the line of the side member. Wooden portable ladders generally have no such caps.

However, the area of contact of the end caps with the ground, even if ribbed, is very small, and hence slippage can still and does occur. To overcome the problem, a second person, in addition to the person up the ladder, is usually employed to stand on the lowest rung of the ladder (but such a practice increases labour costs), or pegs are driven into the ground against the bottom end of the side member (but such practice can unacceptably damage the ground). Ladder stoppers are also known comprising an aluminium T-piece bonded to a vulcanised rubber base, part of which can be slipped under the ladder caps.

There is therefore a need for a device that can be used on ladders to enable a workman to work up a ladder in the knowledge that any tendency to slip is considerably reduced.

According to the present invention, there is provided a portable ladder having improved resistance to slippage which comprises side members and rungs and at least one securing member which is pivotally and latchably attached to the lower end of at least one side member, the securing member having friction member on its lower surface for co-operating with the ground on which the ladder is to be mounted, the pivot being arranged so that the securing member is not proud of the lower end of the side member when the securing member is not in use.

Therefore in operation, the ladder is placed against, for example, a wall, and rests on the ground. The securing member is placed on the ground by pivoting it from the side member, and is locked into position on the ground using the latching member. The friction member on the lower surface of the securing member is thus firmly on the ground to resist slippage of the ladder.

The securing member may be made from any suitable material provided that it is strong; conveniently it can be made from any material used in the manufacture of ladders, such as, for example, aluminium or aluminium alloy, steel. The securing member may be tubular or have a rectangular or T- or I-cross-section, but preferably has a flat lower surface. The securing member is pivotally attached at or towards the lower end of at least one, preferably both, side member. This is to enable the securing member to rest against the ladder during non-use, and to allow the securing member to be adjusted to rest on the ground when the ladder is being set up for use. The pivot can, for example, be a hinge or a bolt or rivet through both the securing member and the side member. The pivot can be provided with biassing member, suitably a spring, which bias the securing member towards the ladder. The pivot can provide that the securing member rests on the ground outward or inward of the ladder, that is the angle between the ground and the ladder can be obtuse or acute, preferably acute. Preferably the securing member is pivotally attached to both side members and comprises a plate extending essentially completely between the side members. The pivot is arranged so that when the securing member is not in use it is not proud of the lower end of the side member.

The friction member on the securing member can be any material that substantially increases the friction between the securing member and the ground. Suitable material includes, for example, rubber, including vulcanised rubber, and similar material such as semi-rigid thermoplastic, and such material may include ridges and dimples on its lower surface as an aid to friction. The friction member might include small metal studs or spikes for aiding grip onto the ground. In a modification of the friction member, there may be provided additional mechanism for raising and lowering such studs or spikes as required. The friction member may be replaceable, and the securing members may be interchangeable so that a variety of friction member may be used as appropriate for variation in the ground type that the ladder may be required to rest. The securing member with the friction member attached can be used in conjunction with conventional end caps. The friction member therefore spreads friction contact over a wide area so increasing stability of the ladder and security for the user.

The securing member is latchably attached to the lower end of at least one side member. The latch is intended to ensure that the securing member stays locked in position when it has been placed on the ground. The latching member may comprise an arm, of adjustable length, which swings out from the side member and fits into a co-operating receptor on the securing member. Thus, after the securing member has been pivoted onto the ground, the length of arm of the latching member may be adjusted to ensure that the securing member remains firmly on the ground. More conveniently, the latching member may be a ratchet mechanism on or associated with the pivot whereby the action of rotating the securing member on the pivot acts against a ratchet, which can then be released after the ladder has been used. Thus, after the securing member has been pivoted onto the ground against the ratchet, the securing member is firmly located on the ground immediately after the ladder has been placed against, for example, a wall. After use, the ratchet can be released and the securing member can be pivoted back against the ladder. The latching member may also be a simple friction device on the pivot. Preferably, the latching member comprises stays which swing out from the side member and co-operate with notches in the securing member.

In a further aspect of the present invention, a kit of parts is provided for use in improving resistance to slippage of a portable ladder which comprises at least one securing member, pivot member and latching member for attachment to the lower end of at least one side member of the ladder, the securing member having friction member on its lower surface for co-operating with the ground on which the ladder is to be mounted and the pivot being arranged so that the securing member is not proud of the lower end of the side member when the securing member is not in use.

Figure 2:
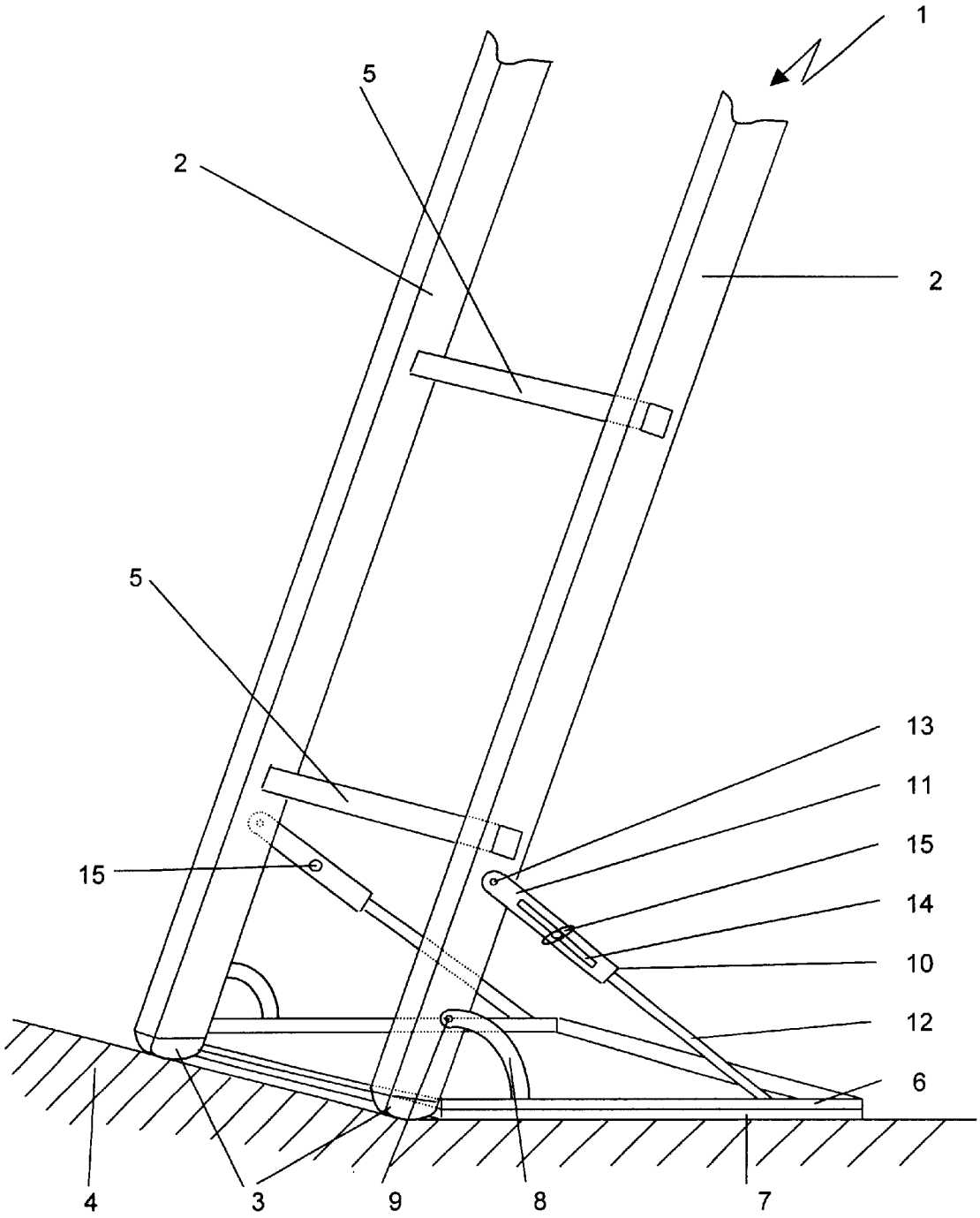
Figure 3:
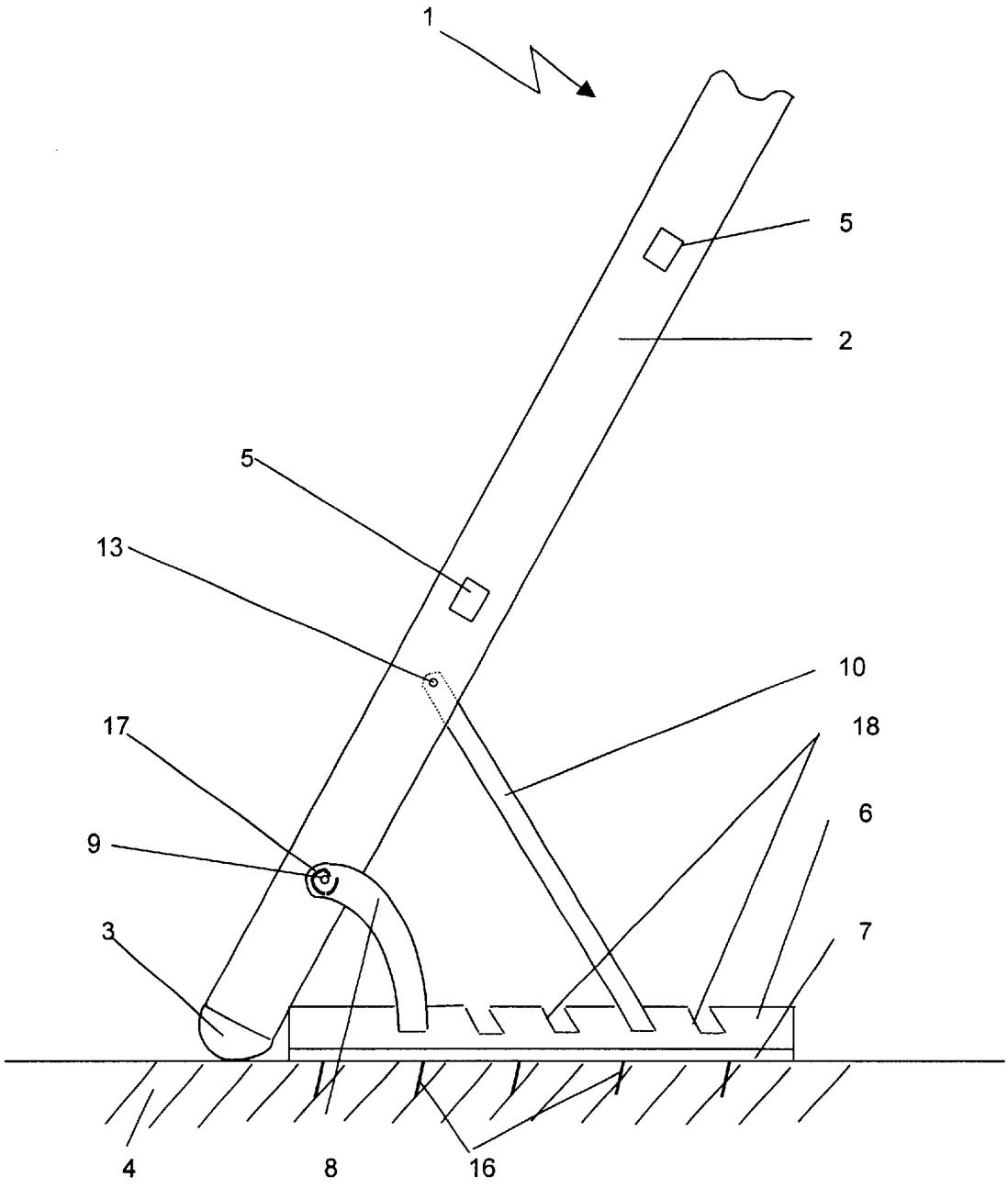

The invention is illustrated with reference to the accompanying figures in which FIG. 1 shows a conventional ladder having an end stops at its lower ends, FIG. 2 shows an erected ladder according to the invention, and FIG. 3 is a side view of a further embodiment according to the invention.

FIG. 1 shows a conventional ladder 1, having side members 2, at the lower end of which are located end caps 3 which are resting on ground 4. This drawing, which is an enlargement of an actual photograph, illustrates the very small area of the end cap which is in contact with the ground.

In FIG. 2, the ladder 1 has side members 2 at the lower ends of each of which are located end caps 3 resting on the ground 4. The ladder is provided with conveniently spaced rungs 5. At the lower end of the ladder is located securing member 6 made from aluminium alloy to which is bonded friction member 7 made from vulcanised rubber. The securing member 6 is provided with pivot members 8 which at one end are fixed, conveniently by welding or by bracket on the securing member (not shown) to opposite sides of the securing member, and at the other end are mounted through bolts 9 to the side members of the ladder. The pivot members are arcuate in shape to allow the securing member, when not in use to be positioned essentially flat against the ladder and not proud of the lower ends of the side members. Stays 10 provide latching of the securing member into position after the securing member has been laid flat against the ground. The stays comprise two arms 11 and 12, arm 11 being pivotally mounted by bolt 13 to the side member of the ladder, and arm 12 being fixed or similarly pivotally mounted to the securing member. Arms 11 and 12 are provided with co-operating slots 14 linked through a wing nut and bolt 15.

In operation, the ladder is placed on the ground and against a wall. The securing member is pivoted so as to place it on the ground and the latching arms bolted together to ensure that the friction pad of the securing member is firmly at an acute angle to the ground. After use, the latching arms are loosened and the securing member pivoted to lie against the ladder.

FIG. 3 is a side view of a ladder fitted with an alternative embodiment according to the invention. FIG. 3 shows a ladder 1 having a side member 2 at the lower end of which is located end caps 3 resting on the ground 4. The ladder is provided with conveniently spaced rungs 5. At the lower end of the ladder is located securing member 6, has width about that of the ladder, and is made from aluminium alloy to which is bonded friction member 7 made from vulcanised rubber, and provided with spikes 16. The securing member 6 is provided with pivot member 8 which at one end is fixed, conveniently by welding or by bracket on the securing member (not shown) to opposite sides of the securing member, and at the other end is mounted through bolt 9 to the side member of the ladder. A flat spring 17 is fitted around the bolt 9, the spring being biassed to bring the securing member 6 against the side member 2. The pivot member is arcuate in shape to allow the securing member, when not in use to be positioned essentially flat against the ladder and not proud of the lower end of the side member. The securing member is provided with notches 18 (of which for clarity only four are shown) positioned along its side adjacent the ladder. Stay 10 is mounted at its upper end on bolt 13 on the inside surface of the side member, and can swing freely about bolt 13, and is adapted at its lower end to engage with a notch 18 so as to provide latching.

In operation, the ladder is placed on the ground and against a wall. The securing member is pivoted against the bias of spring 17 so as to place it on the ground. Stay 10 is located in an appropriate notch in the securing member to provide necessary latching. The appropriate notch used will depend upon the angle of the ladder to the ground; the steeper the angle, the closer the notch used to the pivot. Spikes 16 provide further security against ladder slippage by being pressed in to the ground. After use, the ladder is moved away from the wall, the securing member moved a little distance against the spring bias to release the stays from the notch, the securing member is allowed to move back to the ladder using the bias of the spring 17, at the same time trapping the stays against the side members.

What is claimed is:

1. A portable ladder having resistance to slippage on ground, which comprises side members each having a lower end and rungs secured therebetween;

a securing member which is pivotally attached to the lower ends of both side members;

the securing member comprising a plate extending essentially completely between the side members and having an upper surface and a friction member on its lower surface for co-operating with the ground on which the ladder is to be mounted;

the pivot being arranged so that, when the ladder is mounted on the ground, the securing member is capable of pivoting between a first position in which the upper surface of the securing member rests against the side members and a second position inward of the side members in which the friction member rests on the ground; and latching members attached to a respective one of said side members for releasably locking the securing member into the second position, each latching member comprising a ratchet mechanism on the pivot whereby action of rotating the securing member on the pivot acts against the ratchet mechanism to a latched second position from which the securing member can be released.

2. A portable ladder as claimed in claim 1 in which the securing member is pivotally attached to each of the two side members.

3. A portable ladder as claimed in claim 1 in which the pivot comprises a bolt or rivet about which the securing member can rotate.

4. A portable ladder as claimed in claim 1 in which the securing member is biassed towards the side member.

5. A portable ladder as claimed in claim 1 in which the securing member is interchangeable.

6. A portable ladder as claimed in claim 1 in which the friction member comprises rubber or semi-rigid plastics material having ridges or dimples on its lower surface.

7. A portable ladder as claimed in claim 1 in which the friction member is replaceable.

8. A portable ladder having resistance to slippage on ground, which comprises side members each having a lower end and rungs secured therebetween;

a securing member which is pivotally attached to the lower ends of both side members;

the securing member comprising a plate extending essentially completely between the side members and having an upper surface and a friction member on its lower surface for co-operating with the ground on which the ladder is to be mounted;

the pivot being arranged so that, when the ladder is mounted on the ground, the securing member is capable of pivoting between a first position in which the upper surface of the securing member rests against the side members and a second position inward of the side members in which the friction member rests on the ground; and latching members attached to a respective one of said side members for releasably locking the securing member into the second position, each latching member comprising an arm attached to a respective one of the side members and having adjustable length which swings out from the respective side member and fits into a co-receptor on the securing member.

9. A portable ladder as claimed in claim 8 in which the securing member is pivotally attached to each of the two side members.

10. A portable ladder as claimed in claim 8 in which the pivot comprises a bolt or rivet about which the securing member can rotate.

11. A portable ladder as claimed in claim 8 in which the securing member is biassed towards the side member.

12. A portable ladder as claimed in claim 8 in which the securing member is interchangeable.

13. A portable ladder having resistance to slippage on ground, which comprises side members each having a lower end and rungs secured therebetween;

a securing member which is pivotally attached to the lower ends of both side members;

the securing member comprising a plate extending essentially completely between the side members and having an upper surface and a friction member on its lower surface for co-operating with the ground on which the ladder is to be mounted;

the pivot being arranged so that, when the ladder is mounted on the ground, the securing member is capable of pivoting between a first position in which the upper surface of the securing member rests against the side members and a second position inward of the side members in which the friction member rests on the ground; and latching members attached to a respective one of said side members for releasably locking the securing member into the second position, each latching member comprising a stay swingably mounted at one end of a respective one of the side members, the other end for engagement with notches provided in the securing member.

14. A portable ladder as claimed in claim 13 in which the securing member is pivotally attached to each of the two side members.

15. A portable ladder as claimed in claim 13 in which the pivot comprises a bolt or rivet about which the securing member can rotate.

16. A portable ladder as claimed in claim 13 in which the securing member is biassed towards the side member.

17. A portable ladder as claimed in claim 13 in which the securing member is interchangeable.

* * * * *